US009950204B2

(12) United States Patent
Eisenblaetter

(10) Patent No.: US 9,950,204 B2
(45) Date of Patent: Apr. 24, 2018

(54) PORTABLE SPORTS DEVICE

(71) Applicant: GERD EISENBLAETTER GMBH, Geretsried, DE (US)

(72) Inventor: Gerd Eisenblaetter, Geretsried (DE)

(73) Assignee: GERD EISENBLAETTER GMBH, Geretsried (DE)

( * ) Notice: Subject to any disclaimer, the term of this patent is extended or adjusted under 35 U.S.C. 154(b) by 0 days.

(21) Appl. No.: 15/156,435

(22) Filed: May 17, 2016

(65) Prior Publication Data

US 2016/0339290 A1 Nov. 24, 2016

(30) Foreign Application Priority Data

May 22, 2015 (DE) ..... 10 2015 007 083

(51) Int. Cl.

| | |
|---|---|
| ***A63B 21/045*** | (2006.01) |
| ***A63B 21/00*** | (2006.01) |
| ***A63B 23/035*** | (2006.01) |
| ***A63B 21/075*** | (2006.01) |
| *A63B 71/00* | (2006.01) |
| *A63B 21/068* | (2006.01) |
| *A63B 21/16* | (2006.01) |

(52) U.S. Cl.

CPC ..... *A63B 21/0455* (2013.01); *A63B 21/075* (2013.01); *A63B 21/153* (2013.01); *A63B 21/4035* (2015.10); *A63B 21/4043* (2015.10); *A63B 23/03508* (2013.01); *A63B 23/03516* (2013.01); *A63B 21/00061* (2013.01); *A63B 21/00065* (2013.01); *A63B 21/068* (2013.01); *A63B 21/16* (2013.01); *A63B 71/0054* (2013.01)

(58) Field of Classification Search

CPC ..... A63B 23/03508; A63B 23/03516; A63B 21/4043; A63B 21/4035; A63B 21/075; A63B 21/068; A63B 21/153; A63B 21/16; A63B 21/00065; A63B 21/00061; A63B 71/0054

See application file for complete search history.

(56) References Cited

U.S. PATENT DOCUMENTS 4,233,844 A * 11/1980 Dreisinger ..... A63B 23/12 482/115
5,259,269 A * 11/1993 Swenson, Sr. ..... F16F 15/283 74/571.11
6,939,271 B1 * 9/2005 Whan-Tong ..... A63B 22/001 482/52

(Continued)

FOREIGN PATENT DOCUMENTS

DE 9205777 U1 * 7/1992 ..... A63B 21/227
DE 102011105609 12/2012

*Primary Examiner* — Stephan R Crow
*Assistant Examiner* — Megan Anderson
(74) *Attorney, Agent, or Firm* — Grossman, Tucker, Perreault & Pfleger, PLLC

(57) ABSTRACT

The invention relates to a portable sports device and particularly a training device for muscle building, with at least one handle and a centrifugal mass operatively connected thereto and mounted on a shaft, which is rotatable by pulling a pull rope fixed to and wound up on the shaft, and with at least one removable additional mass element arrangeable on the centrifugal mass, the at least one additional mass element being configured in the form of a circular ring piece or a circular segment piece.

18 Claims, 4 Drawing Sheets

(56) References Cited

U.S. PATENT DOCUMENTS

| | | | | |
|---|---|---|---|---|
| 7,066,865 | B2 * | 6/2006 | Radow | A63B 22/0235 482/1 |
| 8,708,873 | B2 * | 4/2014 | Birch | A63B 21/00185 482/121 |
| 9,604,099 | B2 * | 3/2017 | Taylor | A63B 22/001 |
| 2002/0086779 | A1 * | 7/2002 | Wilkinson | A63B 23/1209 482/118 |
| 2017/0014661 | A1 * | 1/2017 | Lin | A63B 21/018 |

* cited by examiner

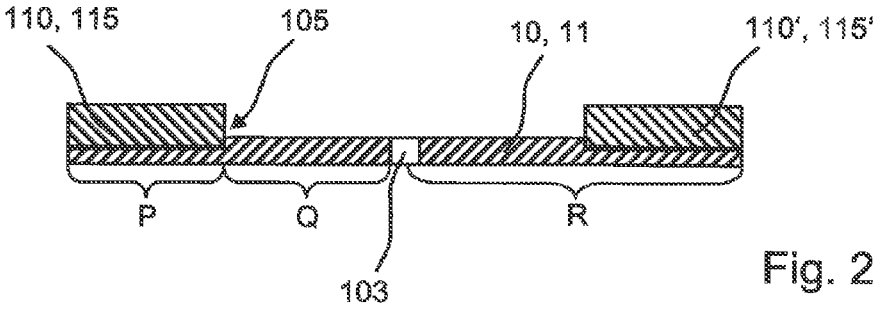
Fig. 2
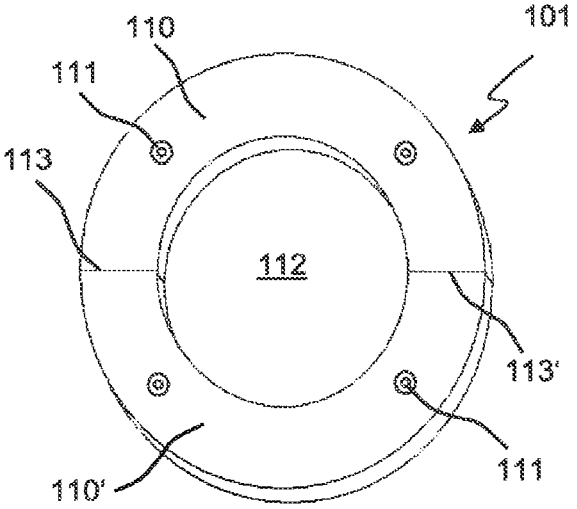
Fig. 3
Fig. 4
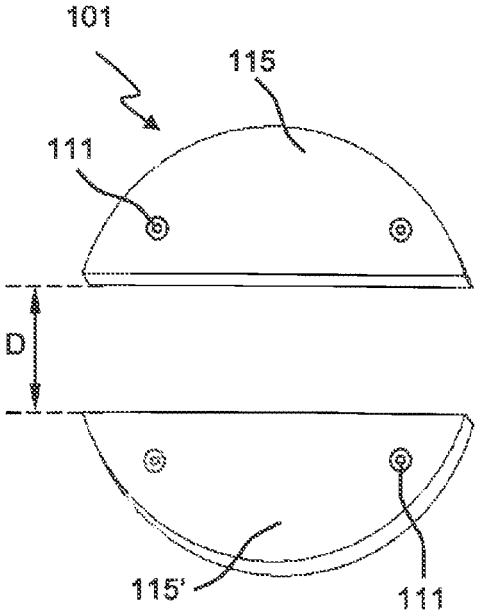

PORTABLE SPORTS DEVICE

FIELD OF THE INVENTION

The invention relates to a portable sports device and particularly to a training device for muscle building, with at least one handle and a centrifugal mass operatively connected to the handle and mounted on a shaft, which can be induced to rotate by pulling a pull rope fixed to and wound up on the shaft. The force to be brought up to that end can be adjusted by means of at least one removable additional mass element arranged on the centrifugal mass.

BACKGROUND

DE 10 2011 105 609 A1 describes such a sports device. It has two handles connected to one another by means of a pull rope. One end of said pull rope is wound up on a shaft mounted on one of the two handles, which shaft also serves as a bearing for the centrifugal mass and particularly flywheel discs. By pulling the pull rope or moving the handles away from one another the pull rope wound up on the shaft can be unwound, thereby inducing the centrifugal mass to rotate. Once the pull rope is completely unwound from the shaft, it is wound up on the shaft in reverse direction due to the rotation of the centrifugal masses until the handles are once again pulled away from each other or the pull rope is completely wound up. In order to continuously keep the centrifugal masses rotating and counter-rotating, the user of the sports device is thus required to constantly change between stress and relief. This results in a very advantageous training effect. In order to vary the training effort, additional mass elements in the form of magnets can be applied to the flywheel discs. Depending on the size and the weight of the additional mass element, the overall weight of the centrifugal mass can be changed and the training effort can be adjusted. Inertia of the centrifugal mass increases along with its overall weight, which leads to an increased force effort for the user both when accelerating and decelerating the centrifugal mass. Thus, the overall weight significantly contributes to the training effort and is particularly suitable for increasing the force effort by additionally attaching additional weight elements. For example, a user may start training without additional weight elements and increase the overall weight when a certain training effect has been reached.

It turned out that the handling of the sports devices known from the prior art, particularly with regard to the adjustment of the training effort by means of additional mass elements on the flywheel discs, is uncomfortable to the user in the long run, leading to a decreased training motivation and thus to a decreased success of training. Further, imbalances sometimes occurred during rotation of the centrifugal mass due to the additional mass elements, which was perceived as uncomfortable by the user.

SUMMARY

It is therefore the object of the present invention to provide options of how sports devices of the aforesaid type can be improved. It is particularly the object of the invention to improve the handling of a sports device of the above type in general and particularly with respect to the adjustment of the training effort such that the sports devices are used regularly and with an increased success of training.

Said object is achieved by a portable sports device as mentioned at the outset and particularly by a training device in which the at least one additional mass element is configured in the form of a circular ring piece or a circular segment piece.

The invention comes with the advantage that it is possible to provide different additional mass elements, which differ particularly in terms of their weight, in order to obtain multiple adjustment levels. Hence, if a user intends to further increase the training effort, he may replace the current additional mass elements by heavier additional mass elements. The additional mass elements are directly attached to the centrifugal mass and preferably fixed to said centrifugal mass by a screw connection. To that end, corresponding holes are provided in both the centrifugal mass and the additional mass elements, through which the screws are guided. However, it is also possible to attach the additional mass elements to the centrifugal mass in a different manner, for example by clamping. The advantage of the invention is that the additional mass elements are removably attached to the centrifugal mass such that they can be mounted to and dismounted from the centrifugal mass in a rapid and uncomplicated manner.

According to the invention, the at least one additional mass element has the shape of a circular segment piece or circular ring piece. In the context of the invention, both shapes refer to a three-dimensional body having two sides each of which has the shape of a circular segment or circular ring piece. These faces are appropriately located over one another in a coinciding manner so that the additional mass element has a rectangular shape in cross-section, the height of which corresponds to the thickness of the additional mass element. The additional mass element is preferably configured to be massive, suitably made of metal, but may also have recesses or be composed of multiple materials, such as plastic and metal. The terms circular ring piece and circular ring sector shall be understood as synonymous in the context of the invention. Likewise, the terms circular segment piece and circle section piece are to be understood as synonymous.

Configuring the additional mass element as a circular segment piece or a circular ring piece provides the advantage that, on the one hand, when attaching the additional mass element to the centrifugal mass usually configured as a flywheel disc, a user can directly recognize the orientation in which the additional mass element is to be attached to the centrifugal mass from the shape of the additional mass element. The additional mass element, having the shape of a circular ring or a circular segment, preferably follows in its shape the peripheral edge of the centrifugal mass so that it can be attached flush with the peripheral edge of the centrifugal mass. Higher centrifugal forces act on the centrifugal mass or the additional mass element on the outer periphery of the centrifugal mass. At the same time, inertia causes higher lever forces to the shaft as it is spaced apart from the rotation axis, which forces lead to the desired increased effort when the centrifugal mass is accelerated and decelerated by a user during workout. Further, the shape of the at least one additional mass element causes a more uniform rotation of the centrifugal mass and thus reduces imbalances during operation.

In order to achieve a particularly uniform rotation of the centrifugal mass and thus also a uniform force development on the pull rope via the shaft, it is advantageous if multiple additional mass elements are provided, which are mounted adjacent to one another such that they are distributed in the peripheral edge region of the centrifugal mass in a most symmetric manner, for example, forming a continuous circular ring on the centrifugal mass. By means of said configuration, the centrifugal forces acting on the additional mass elements are acting symmetrically outward from the centrifugal mass, whereby rotation of the centrifugal mass is not influenced negatively by forces acting on one single side. This way, the centrifugal mass rotates in an especially smooth and balanced manner, thereby preventing tilting forces. As a result, disadvantageous loads on the user are prevented, and comfort and handling of the sports device are improved.

This embodiment is particularly simple when two additional mass elements are present which are configured as semicircular rings. Both additional mass elements arranged on the centrifugal mass together accordingly form a complete circular ring. The two semicircular rings directly rest against each other in each case with two faces at which the circular ring is halved. Due to the fact that the additional mass elements need to be arranged around the shaft, configuration as one component is impossible, at least when a complete circular ring is to be achieved, without dismounting the shaft from the housing. Configuring the additional mass elements as two semicircular rings allows installing them to the centrifugal mass without having to dismount the shaft. At the same time, the simple structure obtained by only two parts of the additional mass prevents arranging the additional mass elements on the centrifugal mass in a wrong manner and thus ensures an error-free functioning of the sports device.

Another preferred embodiment is that two additional mass elements are present each of which is configured as a circular segment piece. Said circular segment pieces are mounted exactly opposite each other on the centrifugal mass, so that their centrifugal forces developing during the rotation of the centrifugal mass balance each other. The two circular segment pieces are arranged on the centrifugal mass spaced from one another and from the shaft, so that sufficient space for coupling elements arranged on the shaft is left free. In a preferred embodiment, the outer circumference of the circular segment pieces is flush with the outer circumference of the flywheel discs.

For adjusting its mass and thus the effort when moving the centrifugal mass, the at least one additional mass element can be varied in terms of its surface area and/or thickness. In the first case, variation is basically possible both in the circumferential and the radial direction. The force effort may also be adjusted as desired via the number of used additional mass elements. In the preferred pairwise use of the circular segment pieces or circular ring pieces, which entirely or almost completely cover the outer circumference of the centrifugal mass, variation of the extension in the circumferential direction is practically excluded, so that in these cases only a change of the additional mass elements with regard to their thickness and their extension in the radial direction remains possible. However, it is possible to attach multiple additional mass elements of comparatively low thickness over one another and thus to change the number of additional mass elements. Preferably, the portable sports device according to the invention includes, as a set, a number of additional mass elements, which may be combined and/or exchanged with one another for adjusting the effort required for the rotation of the centrifugal mass.

Installation of the additional mass elements by a user can be facilitated in that a stop is present on which the at least one additional mass element is stopped. The stop may basically be oriented in both the radial direction, which is particularly preferred, and the circumferential direction of the flywheel disc, and facilitates orienting the additional mass element in a position in which it is to be fixed to the centrifugal mass, for example, by means of a screw connection. The stop may be located on the centrifugal mass and/or the at least one additional mass element. For example, a protrusion may be present on the additional mass element, which is configured such that it hits against the face side of the centrifugal mass or which engages a recess on the centrifugal mass when the additional mass element is arranged on the centrifugal mass. As an alternative, the stop may also be generated in that a circular depression which is open toward the edge of the centrifugal mass is formed in the outer peripheral region of the centrifugal mass, wherein the inner edge of the depression extending concentrically to the outer circumference then forms the stop on which a circular ring shaped additional mass element is stopped when being inserted into the depression. Thus, the centrifugal mass is thicker in the region closer toward the shaft than at its outer circumference and has a step extending concentrically to its outer circumference between the thicker and the thinner region. In this embodiment, another advantage of the configuration of the additional mass elements as two half rings becomes apparent: By engaging around the circular step of the centrifugal mass by one of the two half rings, which rests on the stop with its inner circumference, the stop prevents movement of the additional mass element in two directions at a time—on the one hand, toward the rotation axis, and, on the other hand, transversely to said direction along the abutment surfaces of the half ring for the second half ring.

In order to realize a most compact design of the sports device, it is important that the additional mass elements are as small as possible in order that the housing of the sports device need not be excessively large to be able to accommodate the additional mass elements. It is basically possible to configure the additional mass elements in various shapes, for example, flat on the abutment side facing the centrifugal mass, and rounded-off on the other side. Nevertheless, it is preferred when the at least one additional mass element has an essentially rectangular cross-section. Thus, the at least one additional mass element has two flat sides connected via face sides, the face sides being arranged essentially perpendicular to both flat sides. Said configuration involves relatively much mass while requiring relatively little maximum height, respectively relatively little maximum thickness, of the additional mass elements and can in addition be manufactured in a particularly simple manner.

It is basically advantageous to provide the sports device with a housing which at least partially surrounds the centrifugal mass. On the one hand, the appearance of the sports device can then be freely designed and, on the other hand, safety risks can be prevented that may be caused by the rotating centrifugal mass. However, housings come with the problem that they usually need to be removed or opened for attaching or removing additional mass elements to or from the centrifugal mass. This opening or removing of the housing is an additional step which is perceived to be disturbing during workout. In order to prevent this, provision is made in an advantageous embodiment of the sports device for a housing to be present which at least partially surrounds the centrifugal mass but has at least one opening through which the at least one additional mass element can be arranged on the centrifugal mass or removed therefrom. The opening in the housing thus needs to be sufficiently large in order to be able to move the additional mass elements through said opening. Attachment of the additional mass elements to the centrifugal mass is also effected through the at least one opening. One opening is already sufficient for said purpose as the centrifugal mass can be oriented relative to the opening by rotation such that the attachment position for the respective additional mass element is located beneath the opening. It is of course also possible to provide a distinct opening for each additional mass element in the housing. In each case, opening of the housing for mounting or dismounting the additional mass elements is no longer required.

A particularly advantageous refinement for all embodiments consists in configuring the centrifugal mass as a spoked wheel. In the simplest case, a spoked wheel according to the invention is created by recesses in the disc region of the centrifugal mass. The term "spoked wheel" should also include such embodiments in which generally the mass of a flywheel disc is reduced by means of openings of various shapes in the radial direction closer toward the shaft compared to the outer peripheral region. This also includes a spoked wheel with separate spokes between the hub and the outer circumference. The basic idea in this regard is to distribute the mass of the centrifugal mass such that it is less in the vicinity of the shaft than in the region of the outer circumference. This is also achieved by a spoked wheel in which the hub is connected to an outer ring which makes up for the major part of the mass of the spoked wheel via a ring of spokes. The advantage lies with the fact that mass further spaced from the rotation axis exerts a greater inertia force to the shaft than mass located closer to the rotation axis. When more mass is spaced apart from the rotation axis, the centrifugal mass per se may be configured in a simpler fashion, particularly in the region directly around the shaft. Thus, the overall weight of the sports device can be reduced by the spoked wheel with the force to be brought up by a user remaining the same. If a user has to bring up less force for holding the sports device, he may advantageously concentrate his efforts on the exercises and movements with the device. Workout is more comfortable and more effective.

Pointing in the same direction and advantageous for all embodiments of the invention is that the frame element on which the shaft is mounted consists of a solid material in which at least one recess is provided for weight reduction. For example, a light metal such as aluminum or a light metal alloy such as an aluminum-magnesium alloy is a suitable solid material for the frame element. These are characterized by a particular strength and a low weight. The overall weight of the sports device is even further reduced by the at least one recess in the frame element. The at least one recess is advantageously in a region which in the completely assembled sports device is covered by the housing, or a shell type handle, so that it cannot be seen from the outside. In addition, the at least one recess is appropriately arranged at a location where no great mechanical stress is acting, so that the stability of the frame element is not reduced. Taking these aspects into consideration, as many recesses as possible may be provided in order to achieve an overall weight as low as possible.

The region in which the pull rope of the sports device is wound up on the shaft by rotation of the latter is referred to as winding region of the shaft. It is preferred that the pull rope is wound up in a most uniform fashion via the winding region without forming thickened regions or knots. Such thickened regions may lead to non-uniform or even abrupt stresses acting on the user. In order to prevent the formation of ravels when winding up the pull rope, it is preferred that in each case one reversal shoe is provided as a limit on both sides of the winding region, which has a concave surface toward the winding region. When the pull rope hits the concave surface when winding up the rope, the pull rope turns over and is further wound up on the shaft in the direction away from the reversal shoe. When the pull rope hits the concave surface, the next winding will not only be located above the previous winding, but also further inwards compared to the previous winding. Thus, the concave surface provides an impulse to the pull rope into the varied run direction and thus prevents the formation of ravels in the region of the directional change. This achieves a continuous winding and a calm run of the sports device. The concave surface may be formed in the shape of a cone or a truncated cone or, preferably, in the shape of a dome.

In order to further increase handling comfort of the sports device, it is preferred that the free end of the pull rope opposite the end of the pull rope fixed to the shaft is mounted on the sports device in a damped manner via a spring, particularly a steel spring. Particularly abrupt movements of the pull rope relative to the frame element of the sports device are damped by means of the spring, and are thus not transferred to the user via the handles. In order that the spring can not get jammed, it is preferably mounted inside a cylinder on the frame element which serves as a guide for the spring and the free end of the pull rope. Furthermore, the cylinder can be closed by a cap or a cover. Besides increasing the comfort, abrupt stress of the pull rope and frame element per se can be damped, extending the service life of the sports device.

In order to be able to transport the sports device easily, a fixing brake is preferably provided. The centrifugal mass or the shaft can be arrested by means of said fixing brake, so that the rope can not wind up or unwind by itself. The sports device can then easily be transported in a suitcase or a bag. In a particularly simple form, the fixing brake includes a spring-loaded pin, which is caused by the spring load to engage a latch recess on the centrifugal mass. For example, the latch recess may be a groove in the outer face-sided edge of the centrifugal mass which the pin of the fixing brake can engage. Preferably, multiple latch recesses of this type are distributed in the outer edge of the centrifugal mass in order that the centrifugal mass need not be rotated until the pin of the fixing brake engages one of the recesses. Due to the spring load, the pin will automatically latch into one of the recesses when the fixing brake is actuated by the operator and prevents the centrifugal mass from further rotation. The fixing brake is released by the operator by moving the pin in the counter direction of the latch direction and against the spring load. The fixing brake can be arrested in this position so that it cannot be activated unintentionally when using the sports device.

BRIEF DESCRIPTION OF THE DRAWINGS

The invention will be further described below by exemplary embodiments illustrated in the drawings. In the schematic figures:

FIG. 2 shows a cross-section through a centrifugal mass with additional mass elements;

FIG. 3 is a perspective view of two additional mass elements put together to form a circular ring;

FIG. 4 is a perspective view of two additional mass elements in the form of circular segments;

DETAILED DESCRIPTION

Figure 1:
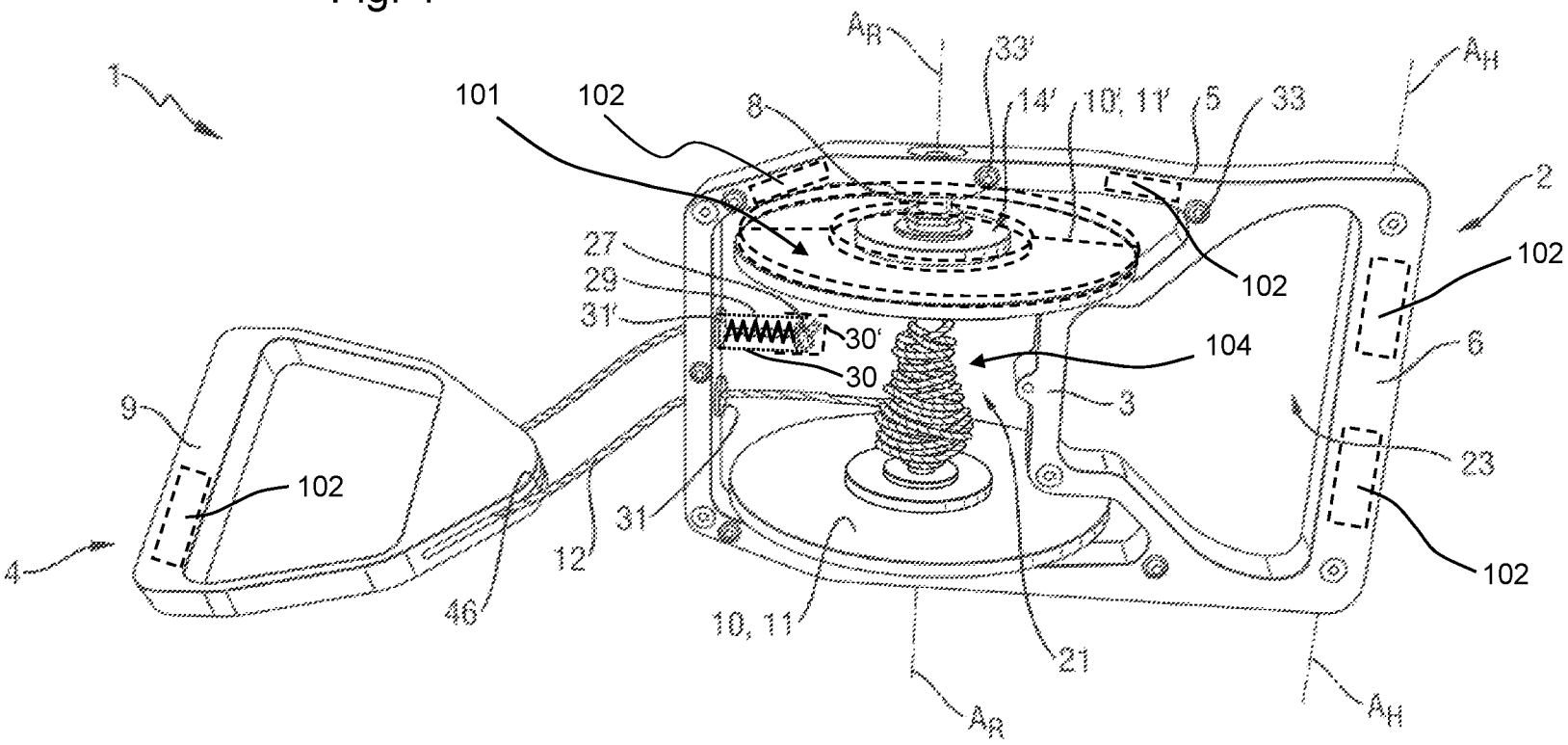
FIG. 1 is a perspective view of the interior of an embodiment of a sports device according to the invention with a wound-up pull rope.
Figure 8:
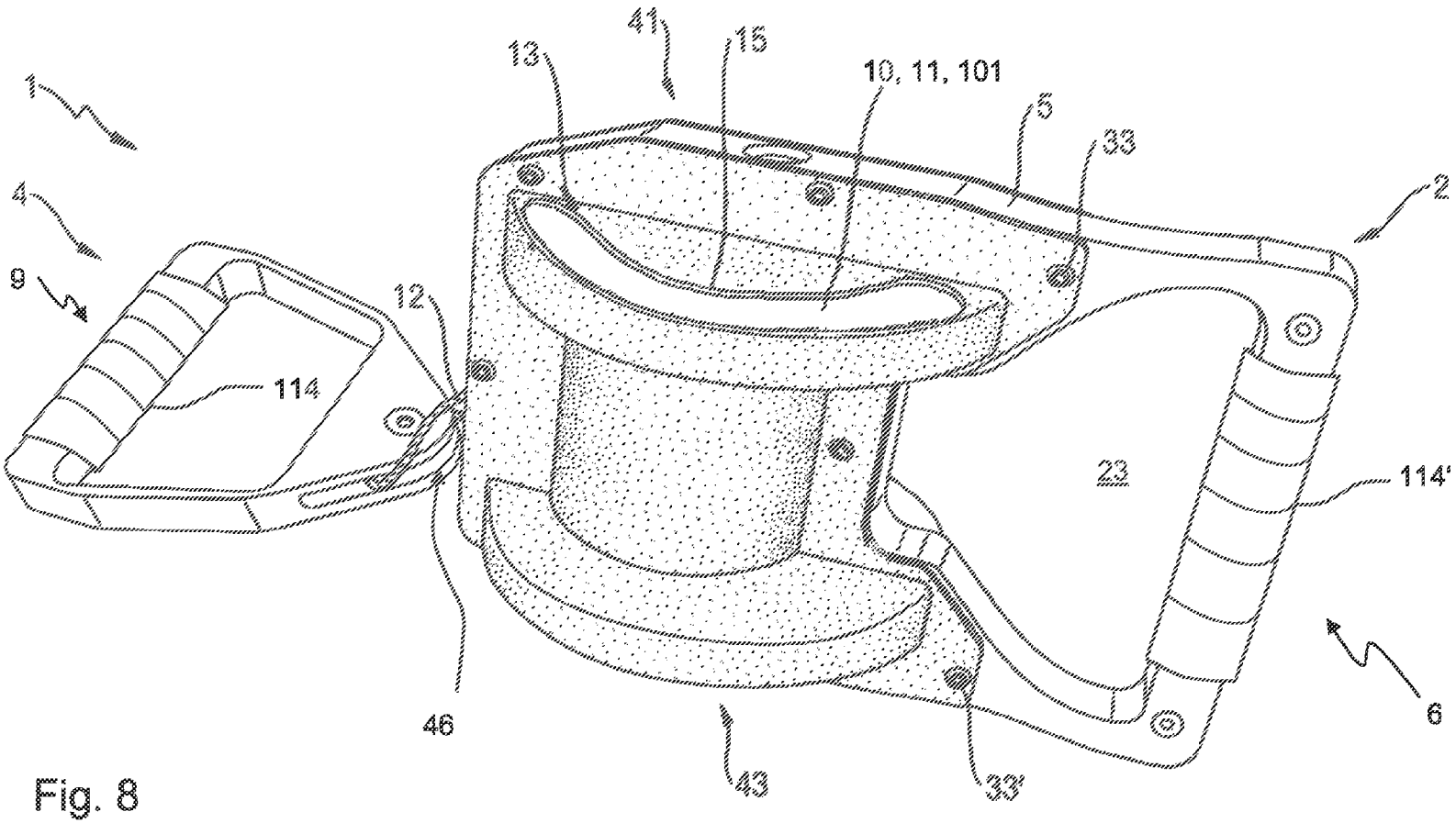
FIG. 8 shows the sports device of FIG. 1 with the housing closed.

The sports device 1 of FIGS. 1 and 8 comprises a first device part 2 and a second device part 4, on which in each case a handle 6, 9 is provided. A centrifugal mass 10, 10' mounted on a shaft 8 is operatively connected to the handle 6 of the first sports device part 2, said centrifugal mass in the present case consisting of two flywheel discs 11, 11' which are centrically positioned on the shaft 8 and are spaced from one another.

The shaft 8 is mounted in a frame element 5 which is made of solid material such as an aluminum-magnesium alloy or an aluminum alloy. The handle 6 is formed integrally with the frame element 5. The shaft 8 is rotatably positioned in the frame element 5 such that its rotation axis $A_R$ runs parallel to the main extension axis $A_H$ of the handle 6. Recesses 102 are provided in the frame element 5, which are to reduce the overall weight of the sports device. By way of example, possible positions of the recesses 102 are illustrated by a dashed line. An important factor for the positions of the recesses 102 is that they will not reduce the stability of the frame element 5 too much, and that they are covered by the housing 13 and the shell type handles 114, 114'.

One part 3 of the frame element 5 is introduced into the free space 21 formed between the two flywheel discs 11, 11' of the centrifugal mass 10, 10' such that a free handle space 23 is formed which allows both gripping around the handle 6 with a hand or introducing a foot and particularly an instep of a foot for certain training methods.

A winding region 104 is formed in the region of the free space 21 along the shaft 8, in which the pull rope 12 running between the two device parts 2 and 4 can be wound up. To that end, the pull rope 12 is attached with a free end to the shaft 8 (hidden beneath the winding) and is positioned such that it is wound up in the winding region 104 upon rotation of the shaft 8 about its rotation axis $A_R$.

As illustrated, the pull rope runs from the shaft 8 to the second sports device part 4, or the handle 9 thereof, where it is deflected at a deflection element 46 and guided back to the first sports device part 2. There, it is fixed on the frame element 5 with its second free end 27. In order to dampen particularly rebound forces in the case of peak stresses within the pull rope 12, the second free end 27 is fixed to the frame element 5 by interconnection of a dampening element 29. In the exemplary embodiment shown, the dampening element 29 is a spring, for example a steel spring. The latter is arranged for guiding inside a tube or cylinder 30 (indicated in FIG. 1). The tube or the cylinder 30 is closed with a cap 30', for example a plastic cap. Arranging the spring in this manner allows balancing abrupt high tensile forces on the pull rope 12, and jamming or entangling of the pull rope or the spring is prevented by the cylinder 30 and the cap 30'.

In order to ensure a safe guiding of the pull rope 12 between the two device parts 2, 4 particularly in a decreasing pull, guide elements 31, 31' are provided on the frame element 5, by means of which the pull rope 12 can be guided through the frame element 5.

The pull rope is in operative connection to the shaft 8 and the flywheel discs 11, 11' coupled thereto in such a way that it is unwound from the shaft 8 when a pull force is applied, for example by a pull oriented in opposite directions on both handles 4, 6. Simultaneously with said unwinding movement an acceleration of the shaft 8 and the centrifugal mass 10, 10', respectively the flywheel discs 11, 11', occurs. Once the pull rope 12 is completely unwound from the shaft 8, the rotation movement of the shaft 8, respectively the centrifugal mass 10, 10', is continued due to inertia, so that the pull rope 12 is wound up on the shaft 8 again in reverse order. Just before the pull rope 12 is completely wound up on the shaft, rotation of the shaft 8 can be stopped by actively pulling both handles 4, 6. Peak stresses occurring at this point are partially dissipated by the dampening element 29. The remaining dissipation is partially effected by overcoming a friction between the centrifugal mass 10, 10', the shaft 8 and the interconnected coupling elements 14, 14', which are configured as a friction clutch.

An optional additional mass 101 on the flywheel disc 11' is indicated by a dashed line in FIG. 1. Such additional masses 101 are attached to both flywheel discs 11, 11', although the example herein refers only to the flywheel disc 11'. FIG. 2 shows a cross-section through a centrifugal mass 10', respectively a flywheel disc 11', having an additional mass 101 attached thereon, which is composed of two additional mass elements 110, 110', 115, 115' configured as semicircular rings or circle segment pieces, as is illustrated in FIGS. 3 and 4.

The semicircular rings 110, 110' of FIG. 3 are put together to form a circular ring in such a way that they touch one another on their abutment surfaces 113, 113'. A recess 112 is provided in the interior of the circular ring, through which the shaft 8 is guided and which is also big enough to receive the coupling elements 14, 14'. Preferably, the additional mass 101 is also spaced from the coupling elements 14, 14' by the recess 112, so that the mass of the additional mass 101 is located farther away from the rotation axis $A_R$. Attachment of the semicircular rings 110, 110' to the flywheel disc 11, 11' is effected by screw connections 111 which run parallel to the shaft 8.

The circular segment pieces 115, 115' of FIG. 4 are arranged with their straight sides spaced apart from one another on the flywheel discs 11, 11', the straight sides running parallel to one another. They are thus located on the flywheel discs 11, 11' directly opposite to one another and are spaced apart from one another and from the shaft 8. Distance D is selected such that sufficient space remains for the coupling elements 14, 14'. Their respective outer circumference runs flush with the outer circumference of the flywheel discs 11, 11'. The mass of the circular segment pieces 115, 115' is thus also spaced from the rotation axis $A_R$. Attachment is effected as in the semicircular rings 110, 110'.

As illustrated in FIG. 2, the semicircular rings 110, 110' and the circular segment pieces 115, 115' have an essentially rectangular cross-section. The flywheel disc 11' has an inner region Q and a mass addition region P, the mass addition region P being located at a greater distance with reference to the rotation radius R from the rotation axis $A_R$, respectively the shaft through hole 103, than the inner region Q. The mass addition region P is less thick than the inner region Q and configured such that it may receive the additional mass 101. Thus, the holes for the screw connections 111 are located in this region of the flywheel discs 11, 11'. When the additional mass 101 is arranged on the mass addition region P, the thickness of the additional mass 101 and the thickness of the flywheel disc 11, 11' in the mass addition region P taken together are greater than the thickness of the flywheel disc 11, 11' in the inner region Q. This provides the advantages of the above described effects of the displacement of the mass away from the rotation axis $A_R$ outward. Further, the flywheel disc 11, 11' has a stop 105 at the transition from the mass addition region P to the inner region Q. In the exemplary embodiment shown, the stop 105 is a step which is created by the different thicknesses of the mass addition region P and the inner region Q.

Figure 5:
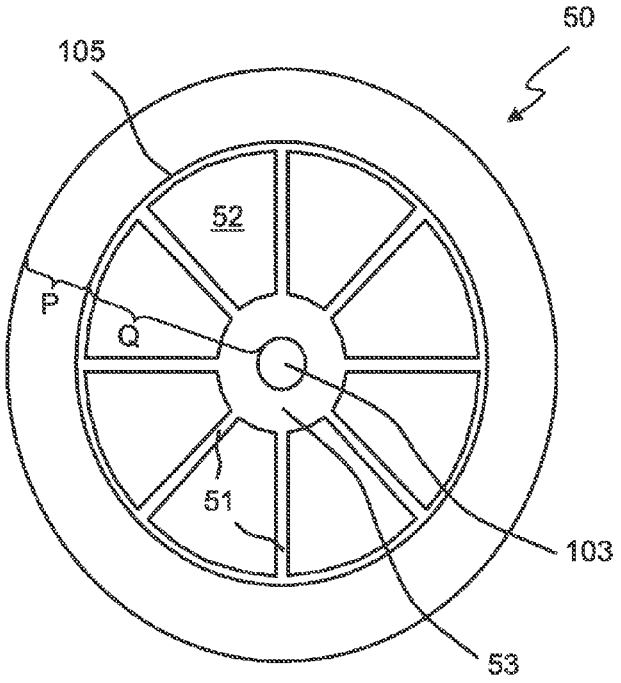
FIG. 5 is a side view of a centrifugal mass in the form of a spoked wheel.

FIG. 5 shows a preferred embodiment of the centrifugal mass 10 as a spoked wheel 50. Appropriately, both centrifugal masses 10, 10', respectively flywheel discs 11, 11', are configured as a spoked wheel 50. The spoked wheel 50 comprises a mass addition region P, which is provided as described above. The inner region Q of the spoked wheel 50 extends from the shaft though hole 103 in the hub 53 to the stop 105 for the additional mass 101 and comprises a number of recesses 52 which are arranged between spokes 51. The spokes 51 connect the hub 53 to the mass addition region P of the spoked wheel 50, which has a stop 105 in the form of a ring-shaped or annular step. Mass is saved by means of the recesses 52 in the region of the spokes 51, i.e., in the inner region Q of the spoked wheel 50. In this region, the centrifugal forces acting on the mass of the spoked wheel during a workout are less than the centrifugal forces acting radially more distant from the rotation axis $A_R$ on a similar mass, which is why mass can be saved for the reduction of the overall weight of the sports device 1 without deteriorating the training effect too much. This achieves an advantageous displacement of the center of mass of the spoked wheel radially away from the rotation axis $A_R$.

Figure 6:
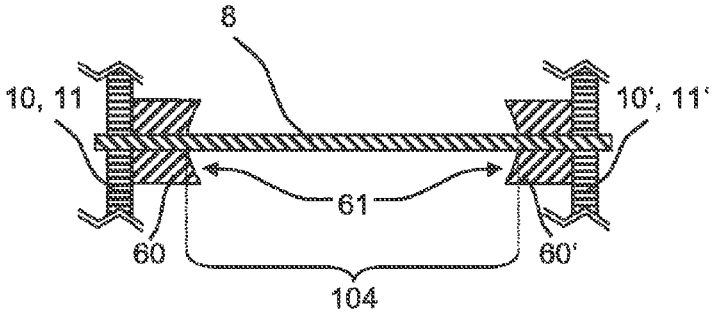
FIG. 6 is a detail view of a shaft with reversal shoes.

In order to achieve a continuous distribution of the pull rope 12 on the winding region 104 of the shaft 8, reversal shoes 60, 60' are provided, as illustrated in FIG. 6. Reversal shoes 60, 60' limit the winding region 104 of the shaft 8 in both directions. They have in each case a concave surface 61 in the direction toward the winding region 104. When the pull rope 12 is wound up on the shaft 8 due to rotation of the latter a winding is created along the longitudinal extension of the shaft 8. When the pull rope 12 then hits one of the reversal shoes 60, 60', respectively one of the concave surfaces 61, the direction of the winding is reversed and the pull rope is further wound up on the shaft 8 in the direction away from the reversal shoe 60, 60'. The reversal shoes 60, 60' thus prevent the formation of ravels of the pull rope 12 on the ends of the winding region 104 of the shaft 8, which would lead to a non-uniform winding or unwinding of the pull rope 12. The pull rope 12 is instead wound up on the shaft 8 in a uniform winding that comprises as few layers as possible arranged over one another.

Figure 7:
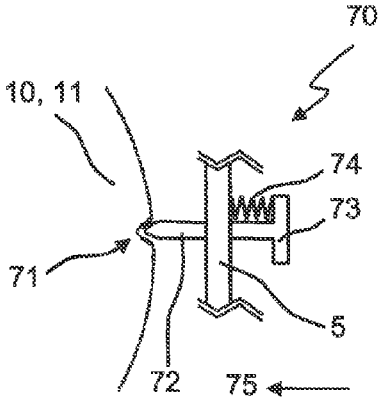
FIG. 7 is a detail view of a fixing brake.

During the transport of the sports device 1, unintentional unwinding of the pull rope 12 is to be prevented. To achieve this, a fixing brake 70 is provided, as illustrated in FIG. 7. The fixing brake 70 comprises a pin 72 which is guided through the frame element 5 of the sports device 1 and connected to a handle head 73. The handle head 73 and the pin 72 are spring-loaded in the direction of the centrifugal mass 10, 10' by a spring 74. By means of said spring-load, the pin 72 latches into one of the latch recesses 71 in latch direction 75, which recesses are formed as grooves over the face-sided outer edge of the flywheel discs 11, 11'. The latch recesses 71 are, for example, milled into the centrifugal mass 10, 10', respectively the flywheel disc 11, 11'. Preferably, multiple, for example, four latch recesses 71 are arranged on the circumference of the centrifugal mass 10, 10', respectively the flywheel disc 11, 11', in a distributed fashion. By the latching of the fixing brake 70, rotation of the centrifugal mass 10, 10', respectively the flywheel disc 11, 11', is hindered. Rotation is still possible when a user strongly pulls the pull rope 12 but comes with a loud sound indicating the activated fixing brake 70. The sound is caused by a sliding of the pin 72 on the outer edge of the flywheel discs 11, 11' and a repeated latching into the respective latch recesses 71. The fixing brake 70 can be released by pulling the handle head 73 counter to the latch direction 75 and counter to the spring load of the spring 74. The fixing brake can be arrested in relation to the frame element 5 which causes the fixing brake 70 to remain in the released position until the user twists the handle head 73 relative to the frame element 5 in such a way that the spring 74 can move the pin 72 through the frame element 5, so that the pin 72 either rests against the circumference of the centrifugal mass 10, 10' or latches into a latch recess 71.

FIG. 8 shows the sports device with a mounted housing 13 which particularly surrounds the shaft 8 and the centrifugal mass 10, 10' at least partially. Here, the housing 13 is secured to the frame element 5 via fastening devices 33, 33'. The handles 6, 9 are covered with shell-type handles 114, 114'. The recesses 102 are hidden beneath the housing 13 and the shell-type handles 114, 114'. In the region of the centrifugal mass 10, 10', the housing 13 has an opening 15 on its upper side 41 and/or its bottom side 43, which allow free access to the centrifugal mass 10, 10' and particularly to the flywheel discs 11, 11'. The centrifugal mass 10, 10' and thus the shaft 8 arranged inside the housing 13 can be induced to rotate via said opening region in order to re-wind the pull rope 12, particularly when the latter is in the rolled-out state. The housing may have another opening on the non-visible rear-sided upper region covered by the frame element 5, which opening corresponds to the opening 15, or only one opening 15 may be provided. The same applies to the non-visible lower-sided region of the sports device.

As can in particular be taken from FIG. 8, the openings 15 allow for installation or removal of the additional mass elements on the flywheel discs 11, 11'. To that end, the openings 15 are sized such that they enable a user to arrange the additional mass elements on or remove them from the flywheel discs 11, 11' through the openings 15 without having to open the housing 13. The screw connections 111 can as well be reached via the openings 15, so that said screws can be loosened or tightened. Therefore, adjustment of the training effort by means of the additional mass elements is possible in a simple and fast manner, whereby motivation of the person working out can be increased.

What is claimed is:

1. A portable sports device comprising:

a shaft, at least one handle, and a centrifugal mass operatively connected to the at least one handle and mounted on the shaft, wherein the centrifugal mass is rotatable by pulling a pull rope fixed to and wound up on the shaft;

at least one removable additional mass element arrangeable on the centrifugal mass, wherein the at least one removable additional mass element is configured in the form of a circular ring piece or a circular segment piece;

wherein the shaft has a winding region to wind or unwind the pull rope by rotation of the shaft; and wherein the winding region has opposing sides and is limited by at least one reversal shoe on each of the opposing sides of the winding region, each of the reversal shoes having a concave surface toward the winding region.

2. The portable sports device according to claim 1, further comprising a stop on which the at least one removable additional mass element is stopped.

3. The portable sport device according to claim 2, wherein the stop is formed by an inner edge of a circular depression in an outer periphery of the centrifugal mass.

4. The portable sports device according to claim 2, wherein the stop is orientated in a radial direction.

5. The portable sports device according to claim 1, wherein the at least one removable additional mass element comprises a plurality of additional mass elements, and wherein the plurality of additional mass elements are configured as semicircular rings, which are mountable adjacent to one another to form a continuous circular ring on the centrifugal mass.

6. The portable sports device according to claim 5, wherein the plurality of additional mass elements are two additional mass elements.

7. The portable sports device according to claim 1, wherein a second end of the pull rope opposite a first end of the pull rope is fixed to the shaft and is mounted on the portable sports device via a spring in a damped manner.

8. The portable sports device according to claim 7, wherein the spring is a steel spring.

9. The portable sports device according to claim 1, further comprising a fixing brake having a pin which is spring-loaded by a spring and which engages a latch recess on the centrifugal mass.

10. The portable sports device according to claim 9, wherein the latch recess is a groove in an outer face-sided edge of the centrifugal mass.

11. The portable sports device according to claim 1, wherein the at least one removable additional mass element is arrangeable flush with an outer circumference of the centrifugal mass in an outer region of the centrifugal mass.

12. The portable sports device according to claim 1, wherein the at least one removable additional mass element comprises two additional mass elements configured as circular segment pieces.

13. The portable sports device according to claim 1, further comprising a housing which at least partially surrounds the centrifugal mass and which has at least one opening through which the at least one removable additional mass element is arrangeable on the centrifugal mass or removable therefrom.

14. The portable sports device according to claim 1, wherein the centrifugal mass is configured as a spoked wheel.

15. The portable sports device according to claim 1, wherein the shaft is mounted on a frame element formed of a solid material having at least one recess for weight reduction.

16. The portable sports device according to claim 1, wherein the portable sports device is a training device for muscle building.

17. A portable sports device comprising:

a shaft, at least one handle, and a centrifugal mass operatively connected to the at least one handle and mounted on the shaft, wherein the centrifugal mass is rotatable by pulling a pull rope fixed to and wound up on the shaft;

at least one removable additional mass element arrangeable on the centrifugal mass, wherein the at least one removable additional mass element is configured in the form of a circular ring piece or a circular segment piece;

wherein the at least one removable additional mass element comprises a plurality of additional mass elements; and wherein the plurality of additional mass elements are configured as semicircular rings, which are mountable adjacent to one another to form a continuous circular ring on the centrifugal mass.

18. The portable sports device according to claim 17, wherein the plurality of additional mass elements are two additional mass elements.

* * * * *